United States Patent [19]

Ehren

[11] 3,957,039

[45] May 18, 1976

[54] ROLLER MASSAGER

[76] Inventor: Fritz H. Ehren, 610 Buchanan St., Clarksville, Ark. 72830

[22] Filed: Feb. 6, 1975

[21] Appl. No.: 547,445

[52] U.S. Cl. ..... 128/58
[51] Int. Cl.[2] ..... A61H 11/00
[58] Field of Search ..... 128/57, 58, 24.3, 67

[56] References Cited

UNITED STATES PATENTS

| | | | |
|---|---|---|---|
| 1,585,767 | 5/1926 | Clarke | 128/57 |
| 2,091,131 | 8/1937 | Cone | 128/57 |

FOREIGN PATENTS OR APPLICATIONS

| | | | |
|---|---|---|---|
| 1,186,841 | 3/1959 | France | 128/58 |
| 140,735 | 2/1935 | Austria | 128/58 |
| 172,599 | 9/1952 | Austria | 128/58 |

*Primary Examiner*—Lawrence W. Trapp
*Attorney, Agent, or Firm*—Stevens, Davis, Miller & Mosher

[57] ABSTRACT

A constant tension full body roller massager having a looped extensible elongated member with spaced rollers rotatably mounted on the elongate member is provided. The loop may be a single extensible member or two extensible members attached to handles to form the loop. The rollers are made of a plastic material or the like and have an uninterrupted peripheral surface curved in cross-section.

14 Claims, 7 Drawing Figures

FIG. 5
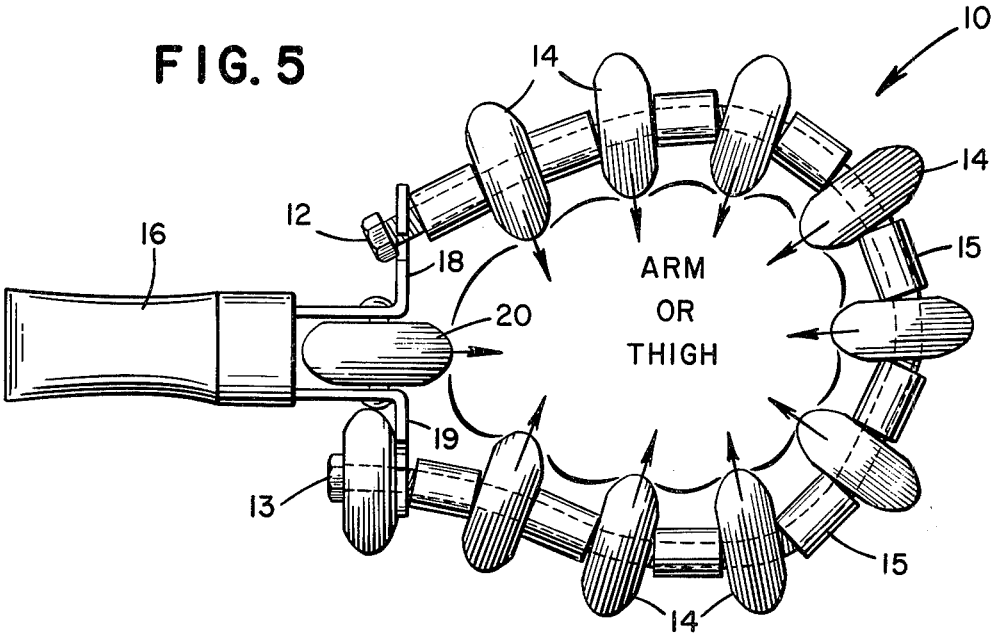
FIG. 6
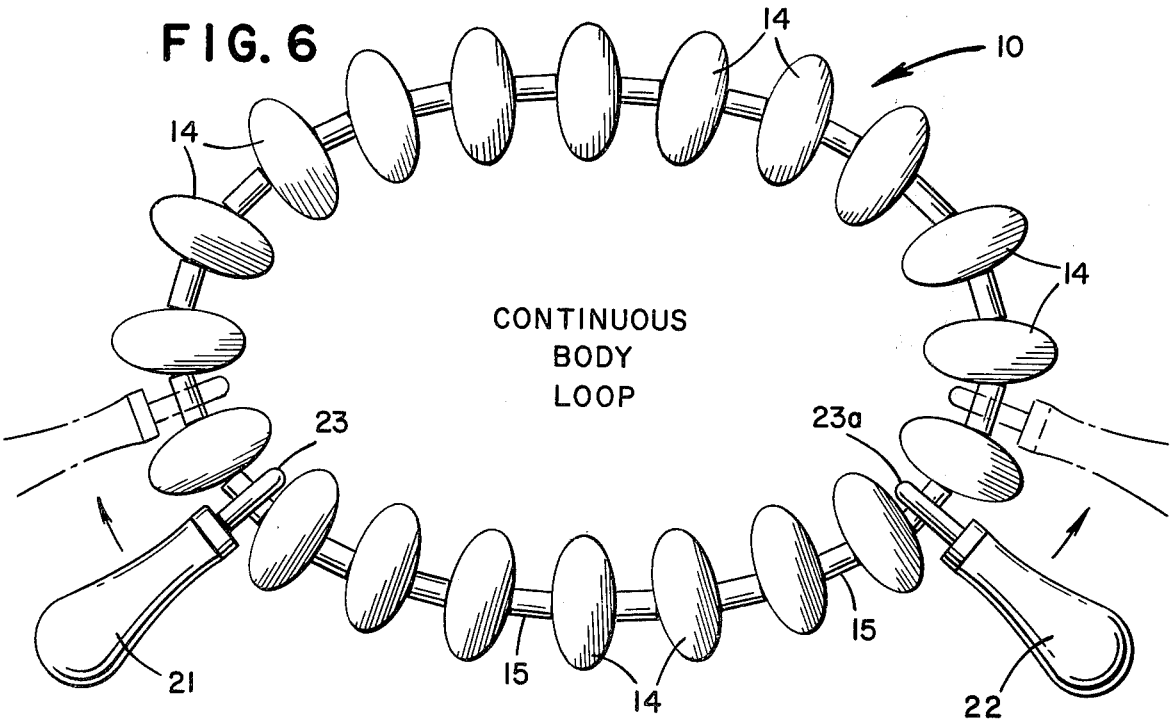
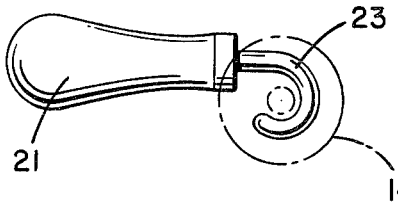
FIG. 7

ROLLER MASSAGER

This invention relates generally to devices for massaging parts of a human body and more particularly to an improved small and inexpensive but effective massaging device which can be manipulated by the person to be massaged.

Various types of massaging devices adapted to be manually actuated by the person to be massaged have been proposed before. Such devices include those having wood, plastic or metal rollers supported on a looped rigid non-extensible member which serves as a shaft for the rollers. Such devices depend primarily upon the pressure exerted by the person for the massaging action. This pressure will vary from person to person and with the length of the massage as the person tires.

An object of the invention is to provide an improved massaging device. Another object of the invention is to provide a massaging device which is adapted to apply a constant pressure against the body using the techniques of effleurage and petrissage more effectively than the human hands. Still another object is to provide a massaging device of relatively simple construction which effectively provides a full massage.

Other objects will become apparent from the following description with reference to the accompanying drawing wherein FIG. 1 is a plan view of one embodiment of the invention;

FIG. 5 is a plan view of a modification of the embodiment illustrated in FIG. 1;

FIG. 6 is a plan view of a second embodiment of the invention; and

FIG. 7 is an enlarged side elevation of an embodiment of a handle adapted to be used in the embodiment of FIG. 6.

The foregoing objects and others are accomplished in accordance with the invention, generally speaking, by providing a massaging device adapted to be looped under tension about a part of the human body and having an extensible, flexible elongate shaft and a plurality of spaced rollers rotatably disposed on the shaft which are made of a material and have a profile which adapt them to provide a full body massage using the techniques of effleurage and petrissage more effectively than the human hands as the device is moved over the part of the body to be massaged. The rollers are made of a material which is sufficiently hard to cause a gentle pinching effect on the skin without bruising. The profile of the roller is such that the peripheral surface is continuous around the circumference thereof and rounded in cross-section to approximate a parabolic shape. The shaft is sufficiently extensible to permit adjustment of the size of the loop of the device to exert a substantially constant pressure against the body as it is moved over the body surface.

Figure 1:
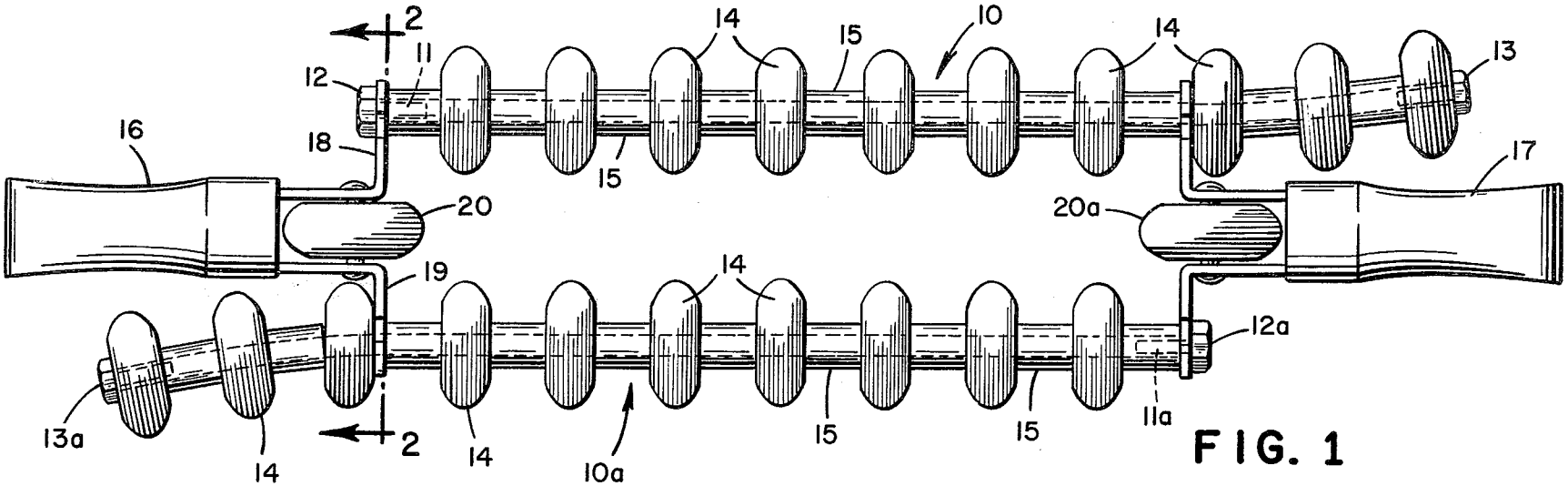
Figure 2:
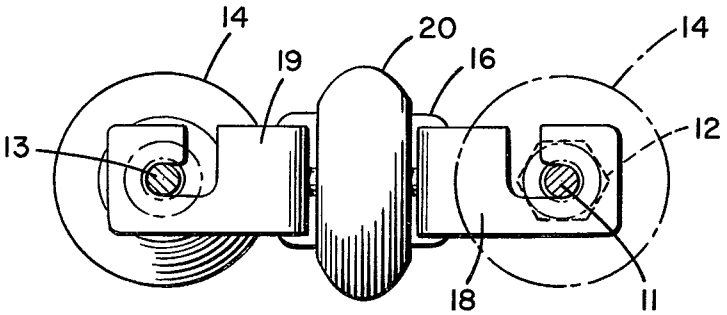
FIG. 2 is a section taken along the line 2—2 of FIG. 1.

Referring now to the drawing and particularly to FIGS. 1 and 2, one embodiment of the invention has a pair of elongate elastic members 10 and 10*a*. Each of members 10 and 10*a* is secured at its ends to threaded rigid rods 11 and 11*a*. Nuts 12, 12*a*, 13 and 13*a* are threadably disposed on the ends of the rods. Elastic members 10 and 10*a* may be coiled springs and the rods may be bolts inserted in the ends thereof and secured thereto. A plurality of rollers 14 are spaced longitudinally along elastic members 10 and 10*a* which serve as extensible shafts on which the rollers are rotatably mounted. Tubular plastic spacing members 15 are provided between rollers 14 to maintain the spacing thereof.

Elastic members 10 and 10*a* are secured to a pair of handles 16 and 17. Handles 16 and 17 include a wood or plastic gripping member and a pair of L-shaped brackets 18, 19 and 18*a*, 19*a* secured thereto. Each bracket has an L-shaped slot for holding an end of an elastic member 10 or 10*a*. As illustrated best in FIG. 2, the threaded rod 11 and 11*a* passes through the slot and the bracket is detachably held between a nut 12 or 12*a* and a spacer 15, and a nut 13 or 13*a* and a spacer 15 or a roller 14. Preferably, each handle 16 or 17 has at least one slotted bracket 18, 19, 18*a* or 19*a* but it is not necessary that both brackets 18 and 19 or both 18*a* and 19*a* of a handle 16 or 17 be slotted. A hole slightly larger than the cross-section of a rod 11 and smaller than a nut may be provided instead of a slot in one of the brackets on a handle and either end of the elastic member fastened thereto. Rollers 20 and 20*a* are preferably provided between the brackets to prevent the brackets from rubbing against the body when the device is used.

Figure 4:
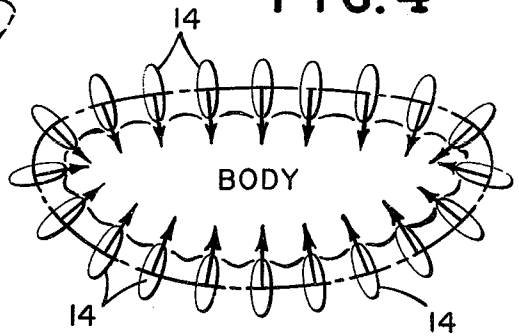
FIG. 4 is a diagrammatic plan view illustrating the device about the body.
Figure 3:
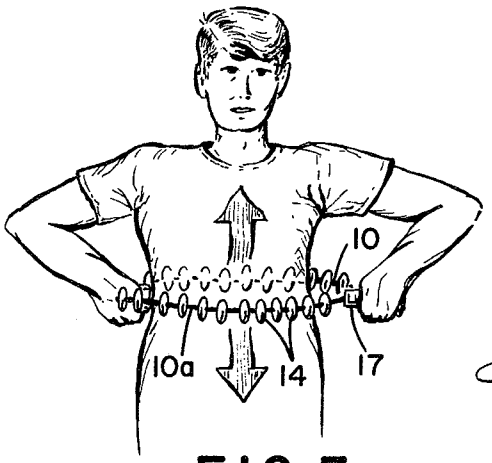
FIG. 3 is a representation of the device of the invention in use for massaging the body about the waist.

The operation of the device about the waist is illustrated in FIGS. 3 and 4. The elastic members 10 and 10*a* carrying rollers 14 are placed about the waist and a handle is grasped by each hand. The elastic members are extended about the body as the device is moved up and down across the body as shown by the arrows in FIG. 3. Because the elastic members 10 and 10*a* are stretched about the body forces are exerted inwardly to press rollers 14 firmly against the body as they are moved up and down. The amount of pressure on the body is determined by the tension on the elastic member which remains substantially constant varying only with change in dimensions of the body as the device moves thereover. The uninterrupted smooth peripheral surfaces of the rollers cause a gentle pinching effect on the skin and tissues, thus breaking down fatty tissue, loosening muscles and increasing blood flow in the area of the body under treatment. The device makes it possible to provide a full body massage using the techniques of effleurage and petrissage more effectively than the human hands because tension is applied simultaneously over an area of the body surface by a plurality of rollers. As illustrated in FIG. 4, the rollers tend to deflect from perpendicular towards each other on the body to provide a slight pinching effect.

If the device is to be used for massaging a leg, arm or other part of the body of relative small cross-section, one of the elastic members 10 or 10*a* may be removed frome one of the handles 16 or 17 and the opposite ends of the remaining member attached to only one handle as illustrated in FIG. 5. A device having an inextensible shaft 10 with rollers 14 is formed into a loop and an end is secured to each of brackets 18 and 19 of handle 16, as illustrated. The device may be moved over the arm or leg with only one hand.

The device may have a single elastic member 10 forming a loop as illustrated in FIG. 6. Handles 21 and 22 having a hook 23 or 23*a* may be fastened to the loop over a spacer 15.

As illustrated in FIG. 1, the internal dimensions of the device may be adjusted by adjusting the length of the extensible members 10 and 10*a* between handles 16 and 17. The area within the loop may be adjusted by changing the length of member 10 and/or 10*a* between the handles. A length of one of the members 10 or 10*a* or of both of them may be extended beyond the brackets to provide the proper dimensions and tension. The internal dimensions of the device of FIG. 6 can also be reduced by placing the hook of handle 23 across two spacers 15 with a portion of the loop extending beyond the handle. The effectiveness of the device will depend upon the relative dimensions of the elastic members between handles and the dimensions of the body. In all cases, the internal dimension of the device will be less than the dimension around the body to be massaged so that the rollers will be pressed against the body. For a person having a waist line of say 32 to 45 inches the internal peripheral measurement of the device preferably should be from about 6 to 12 inches, most preferably 10 inches, less than the waist measurement. This will provide a pressure of about 20 – 30 p.s.i. by the rollers against the body.

The elongate elastic member which provides an extensible shaft for the rollers may be any extensible rod-like member such as, for example, a coil spring or an elastomeric rod or tube such as natural rubber or synthetic rubber. The rollers are preferably molded plastic such as, for example, polyethylene, polyvinyl chloride, nylon, an elastomer such as rubber or polyurethane. The ends of the extensible member may be provided with any suitable means for attaching it to the handles. The hardness of the plastic should be such that a kneading effect is obtained without brusing. Wood is less desirable than plastic because it tends to bruise.

The handle grips may be wood, rigid plastic or any other suitable material. The brackets 18, 18*a*, 19, 19*a* may be metal, rigid plastic or any other suitable material. The spacers between rollers may be any tubular plastic, elastomer or the like. A centrally disposed bore is provided in the rollers for mounting them on the shaft. It is not necessary to provide special bearings in the bore although they may be used, if desired.

Although the invention is described in detail for the purpose of illustration it is to be understood that such detail is solely for that purpose and that variations can be made therein by those skilled in the art without departing from the spirit and scope of the invention except as it may be limited by the claims.

What I claim is:

1. A device for massaging a part of the human body comprising a looped extensible member, a plurality of spaced rollers having a continuous peripheral surface about the circumference thereof, the radially outward portion of the roller being substantially parabolic in cross-section, and a handle which can be attached and removed from the loop without disassembly of the looped member.

2. The device of claim 1 having tubular spacing members between the rollers.

3. The device of claim 1 wherein the handle has a hook adapted to be detachably disposed over the extensible member between the rollers.

4. A device adapted for massaging a part of the human body comprising a looped extensible member, a plurality of spaced rollers having a continuous peripheral surface about the circumference thereof, the radially outward portion of the roller being substantially parabolic in cross-section, and a handle having a pair of L-shaped brackets, each of the brackets having a means for securing an end of an extensible member to the handle, one of said means being an L-shaped slot adapted to receive and detachably secure an end of the said extensible member.

5. The device of claim 4 wherein only one extensible member is shaped as a loop and both of its ends are attached to the same handle.

6. The device of claim 5 wherein the extensible member is an elastomer.

7. The device of claim 4 wherein the rollers are plastic.

8. The device of claim 4 wherein the extensible member is a spring.

9. The device of claim 4 having two elongate extensible members and two handles, a pair of L-shaped brackets secured to each handle, and an L-shaped slot in at least two of the brackets adapted to receive and detachably secure an end of an extensible member to the handle.

10. The device of claim 4 wherein the extensible member is an elastomer.

11. The device of claim 5 wherein the extensible member is a spring.

12. The device of claim 4 wherein a roller is rotatably secured to the handle between the two brackets.

13. The device of claim 4 having two of said handles and a roller rotatably secured to each of the handles between the brackets.

14. The device of claim 4 having tubular spacing members between the rollers.

* * * * *